US006357607B1

(12) United States Patent
Wu

(10) Patent No.: US 6,357,607 B1
(45) Date of Patent: Mar. 19, 2002

(54) RACK FOR WINE GLASSES HAVING SHELF SUPPORTS FOR SLIDABLY RECEIVING A FRAME

(76) Inventor: John-Ching Wu, 4F, No.7, Alley8, Lane 163, Sec. 3, Nei-Hu Rd., Nei Hu, Taipei (TW)

( * ) Notice: Subject to any disclaimer, the term of this patent is extended or adjusted under 35 U.S.C. 154(b) by 0 days.

(21) Appl. No.: 09/688,207

(22) Filed: Oct. 16, 2000

(30) Foreign Application Priority Data

Oct. 20, 1999 (TW) ..... 088217841 U

(51) Int. Cl.[7] ..... A47G 29/00
(52) U.S. Cl. ..... 211/85.29; 211/75
(58) Field of Search ..... 211/85.29, 74–75, 211/88.01, 90.01, 90.02, 94.01, 126.15, 151, 162; 312/72, 122, 126, 128, 131, 132, 408, 260, 261, 330.1, 334.1, 334.7, 334.8, 334.23, 334.24, 334.27–28, 334.32, 350; 248/311.2, 312, 312.1, 317, 424, 429, 298.1, 244, 278.1, 279.1, 287.1, 285.1, 286.1, 295.11

(56) References Cited

U.S. PATENT DOCUMENTS 2,292,865 A * 8/1942 Boddy ..... 312/150
4,700,849 A * 10/1987 Wagner ..... 211/71
4,909,401 A * 3/1990 McConnell ..... 211/74
5,429,252 A * 7/1995 Liu ..... 211/94.01
5,472,167 A * 12/1995 Shillington et al. ..... 248/552
5,785,189 A * 7/1998 Gollob et al. ..... 211/187
5,964,359 A * 10/1999 Marino, Jr. ..... 211/74
6,039,191 A * 3/2000 Purnell ..... 211/118
6,257,425 B1 * 7/2001 Liu ..... 211/90.01

* cited by examiner

*Primary Examiner*—Daniel P. Stodola
*Assistant Examiner*—Jennifer E. Novosad
(74) *Attorney, Agent, or Firm*—Rabin & Berdo, P.C.

(57) ABSTRACT

A multifunction rack for wine glasses, composed of a pair of shelf supports, a tubular frame and a glass board, to be installed to supporting walls in a liquor cabinet. Each of the shelf supports is made with one lateral slide track and one bottom slide track. Both shelf supports are positioned as two parallel lines, with their lateral slide tracks facing each other, where a glass board can be slid in. The tubular frame includes a pair of U-shape support rods and rack bases. Each pair of the U-shape support rods are placed at a fixed interval between each other and then connected by the rack bases at the ends. The tubular frame is to be slid along the bottom slide tracks of the shelf supports and fastened thereto. Inside the liquor cabinet, a set of brass bolts or a pair of support frames is fixed to the walls for holding the glass rack. The glass board of the glass rack serves as a shelf for the cabinet, providing more storage space on the top as well as hanging the wine glasses with the tubular frame on the bottom.

5 Claims, 5 Drawing Sheets

RACK FOR WINE GLASSES HAVING SHELF SUPPORTS FOR SLIDABLY RECEIVING A FRAME

BACKGROUND OF THE INVENTION

I. Field of the Invention

This invention relates generally to a glass rack with enhanced construction and, more specifically, to a multi-function rack for wine glasses to be installed in a liquor cabinet. A set of brass bolts is fixed to the walls inside the cabinet for holding the glass rack. The tubular frame of the glass rack holds wineglasses, and the glass board of the glass rack serves as shelf for the cabinet, providing more storage space on its top. In contrast to traditional glass racks, the present invention has the advantage of having more storage space while requiring no screwing for installation.

II. Description of the Prior Art

Heretofore, it is known to construct a glass rack having a pair of U-shape support rods (a) and rack bases (b) that connect the support rods (a) at the ends (as shown in FIG. 5). A glass rack of such construction typically has each pair of support rods (a) bent inwards, close to each other. Each of the rack bases (b) has two screw holes. For installation, the glass rack is fastened with screws to the bottom of a cabinet or under the shelf inside the cabinet. Wineglasses are turned upside-down, slid along in between the support rods (a), and thus hung on the glass rack. A glass rack of this kind typically requires screwing to fasten the rack to a cabinet. The screwing procedure does not apply to cabinets made of glass or some other special materials.

The present invention improves on the heretofore known glass racks by providing a multifunction rack for wine glasses with enhanced construction. More specifically, the invention is composed of a supporting board, a pair of shelf supports, a tubular frame and a glass board, all being installed inside a cabinet. Each of the shelf supports is made with metal boards and has two corresponding slide tracks. The shelf supports are positioned like two parallel lines so that one of the slide tracks would face inwards and the other would face downwards. The tubular frame consists of a pair of U-shape support rods and a pair of rack bases. As to the support rods, the bottom of the U-shape rods is bent inwards, close to each other. The rack bases connect the support rods and maintain a fixed interval between the support rods. The rack bases are slid along the bottom slide tracks of the shelf supports and thus fastened to the shelf supports. A glass board is then slid along the lateral slide tracks of the shelf supports.

Inside a cabinet, a set of brass bolts or a pair of support frames is fastened on the walls for holding a shelf. The glass board of the glass rack mentioned above can be put in the cabinet by placing the board on the bolts or the support frames. Therefore, the glass board serves as shelf for the cabinet, offering additional storage space on its top while hanging wineglasses with the glass rack positioned below.

SUMMARY OF THE INVENTION

It is therefore a primary object of the invention to provide a multifunction rack for wine glasses that not only hangs wineglasses but also offers storage space on its top. With a set of brass bolts or a pair of support frames fastened to the walls inside a cabinet, the glass board of the present invention can be positioned in the cabinet and serves as a shelf for the cabinet to offer storage space.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
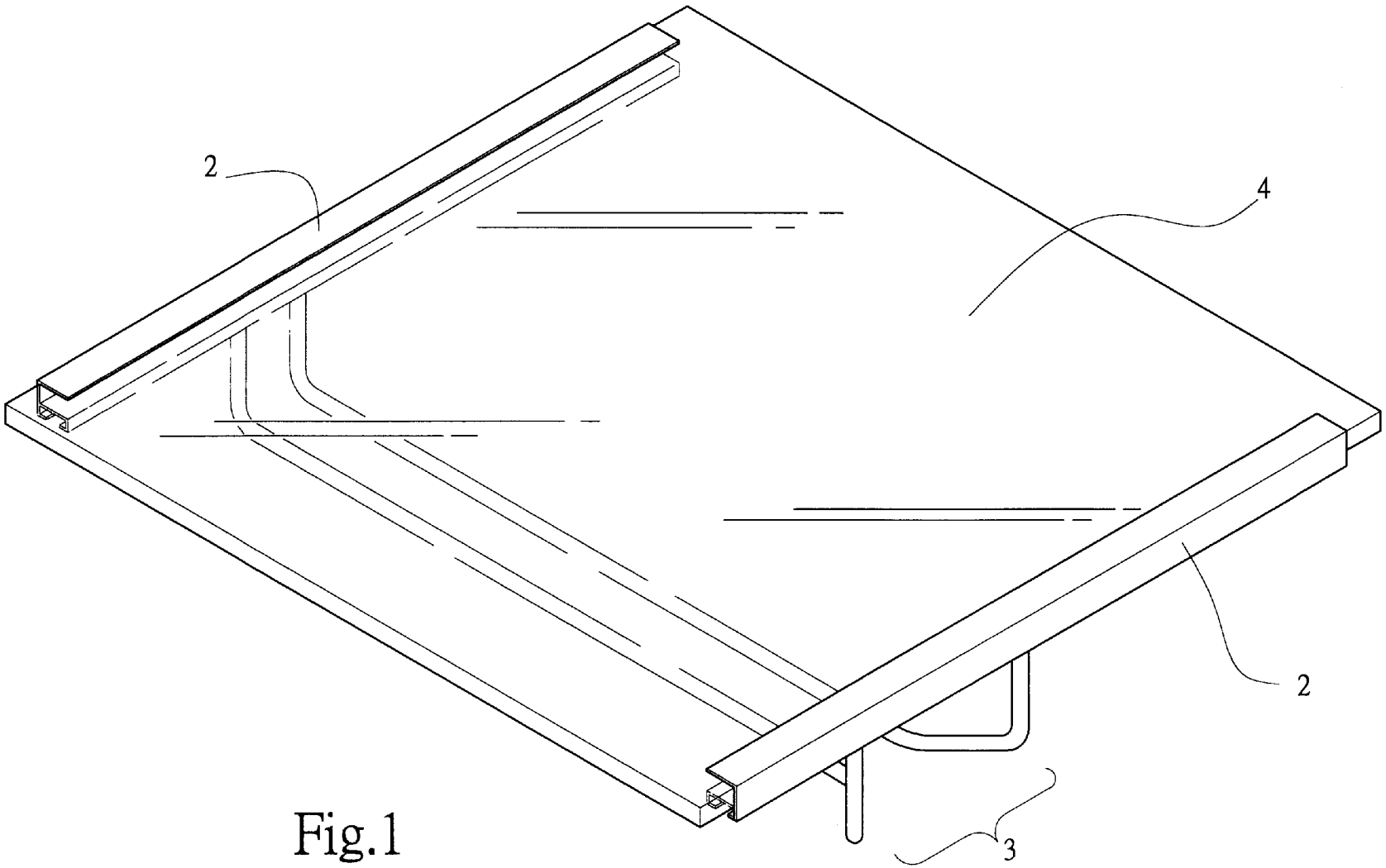
FIG. 1 is a perspective view of the present invention.
Figure 2:
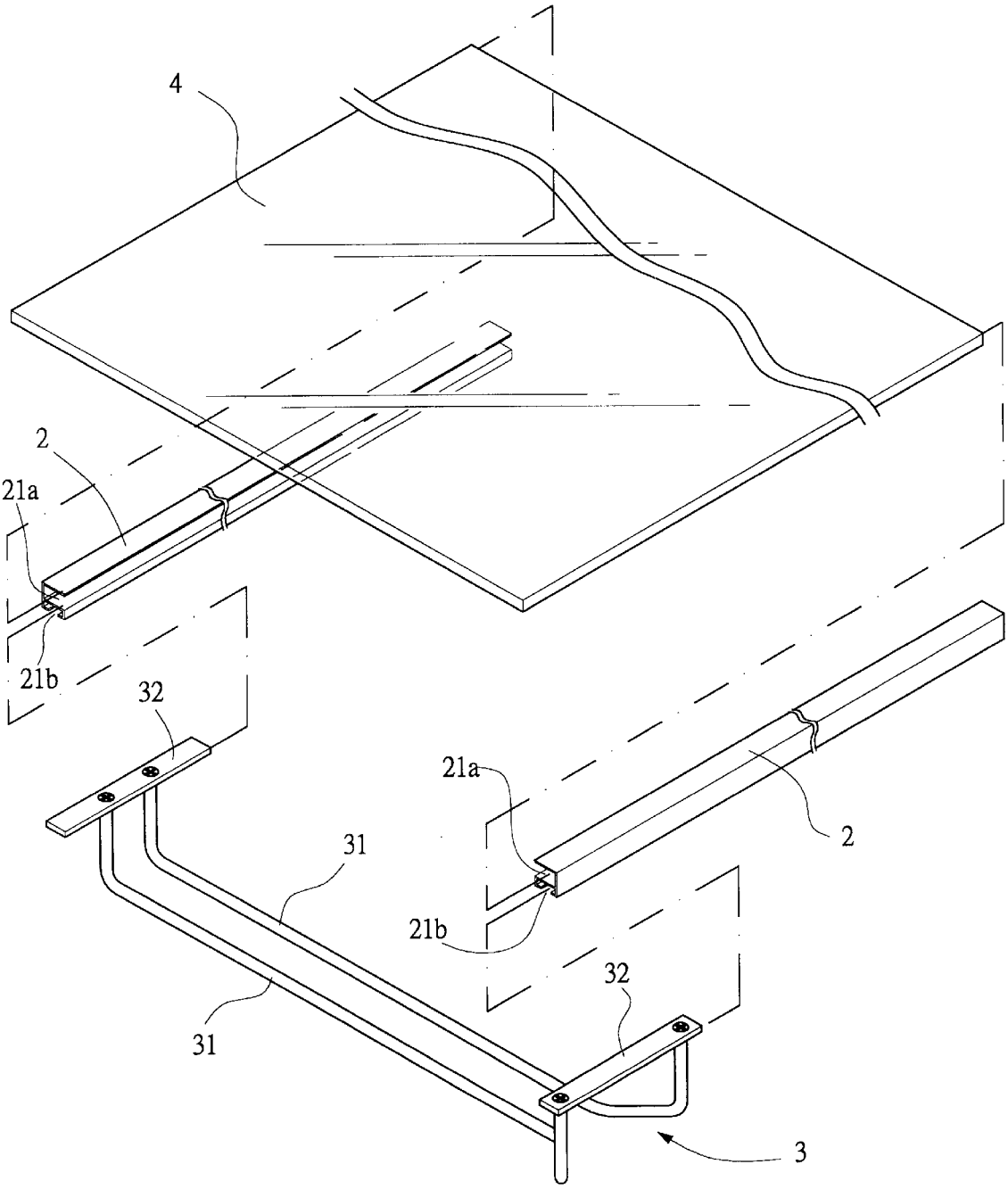
FIG. 2 is an explosive view of the present invention.

Referring to the drawings FIG. 1 and FIG. 2, the glass rack of the present invention is composed of a pair of shelf supports 2, a tubular frame 3 and a glass board (shelf) 4. After being assembled, the glass rack is to be installed to the supporting walls in a liquor cabinet 1. The characteristic of the present invention is that each of the shelf supports 2 is made with metal boards and has two slide tracks 21*a*, 21*b*. The shelf supports 2 are positioned like two parallel lines, with one of the slide tracks (21*a*) facing inwards and the other slide track facing downwards (21*b*). The tubular frame 3 consists of a pair of U-shape support rods 31 and rack bases 32. Each pair of the support rods is positioned with a fixed interval away from each other and is connected by the rack bases 32 at both ends. For each pair of the support rods 31, the bottom of the U-shape is bent inwards, close to each other. The rack bases 32 can be slid along the bottom slide tracks 21*b* of the shelf supports 2, and the tubular frame 3 can be fastened to the shelf supports 2. The glass board 4 is then slid along the lateral side tracks 21*a* of the shelf supports 2.

Figure 3:
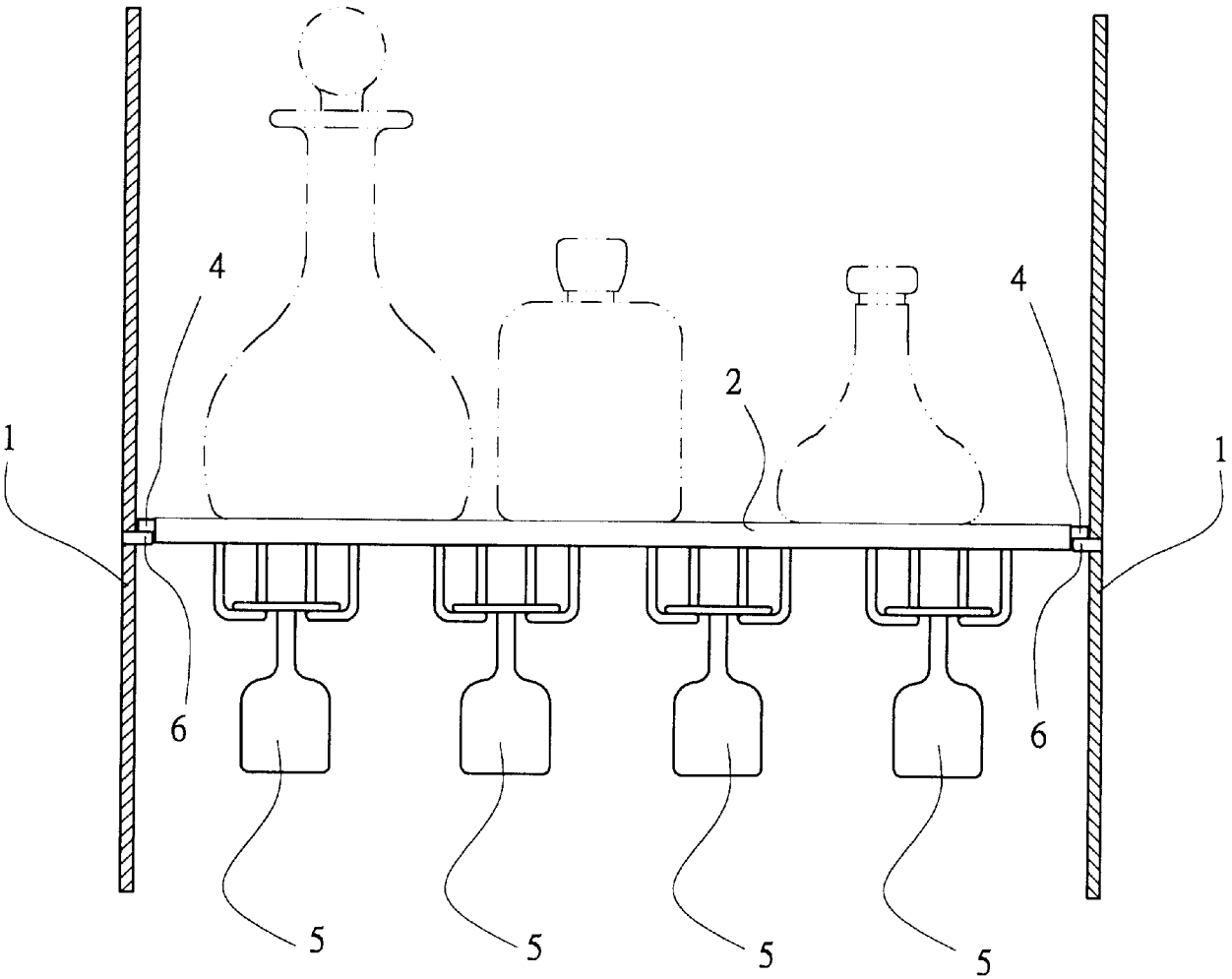
FIG. 3 is an embodiment of the present invention.
Figure 4:
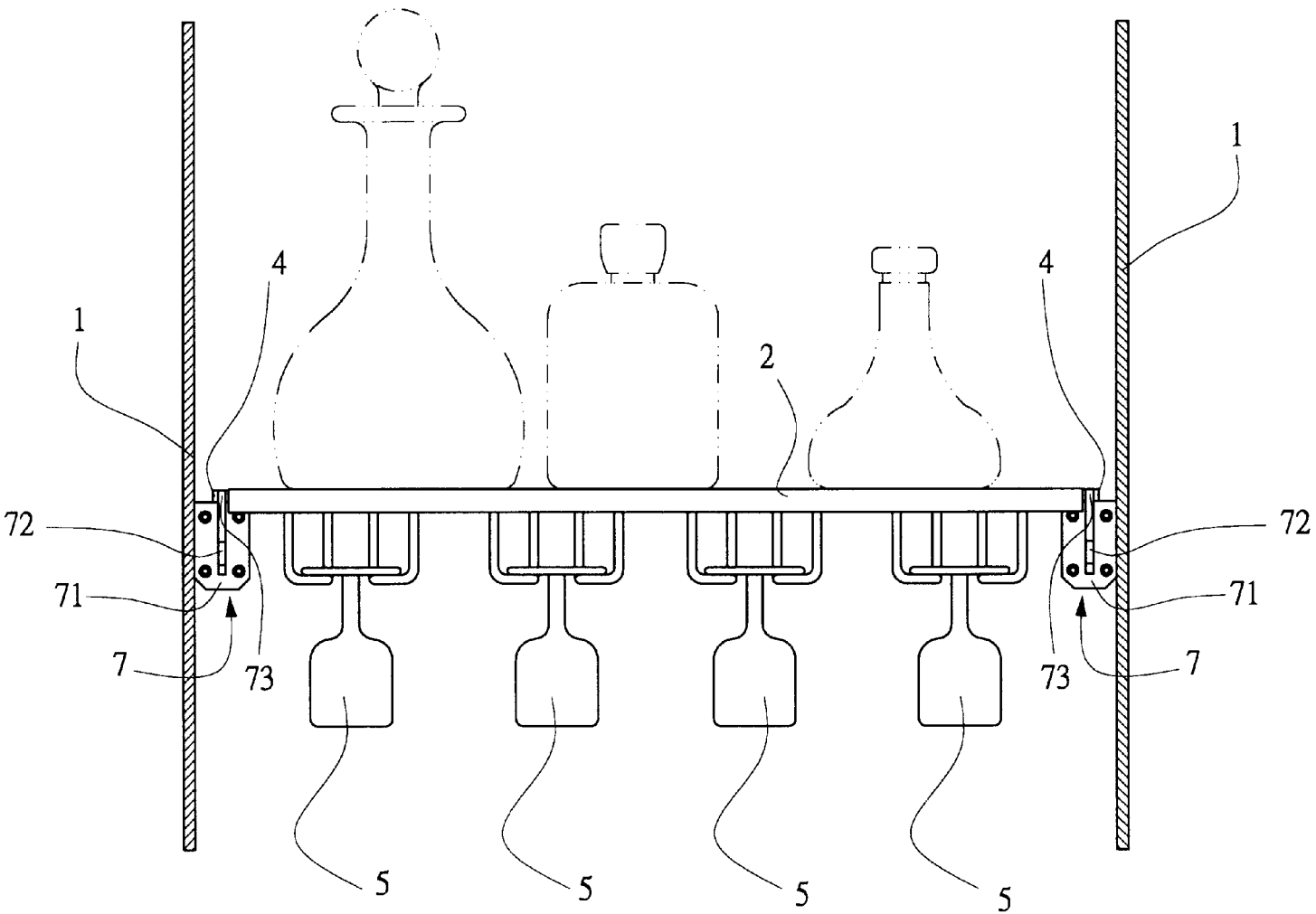
FIG. 4 is a embodiment of the present invention.
Figure 5:
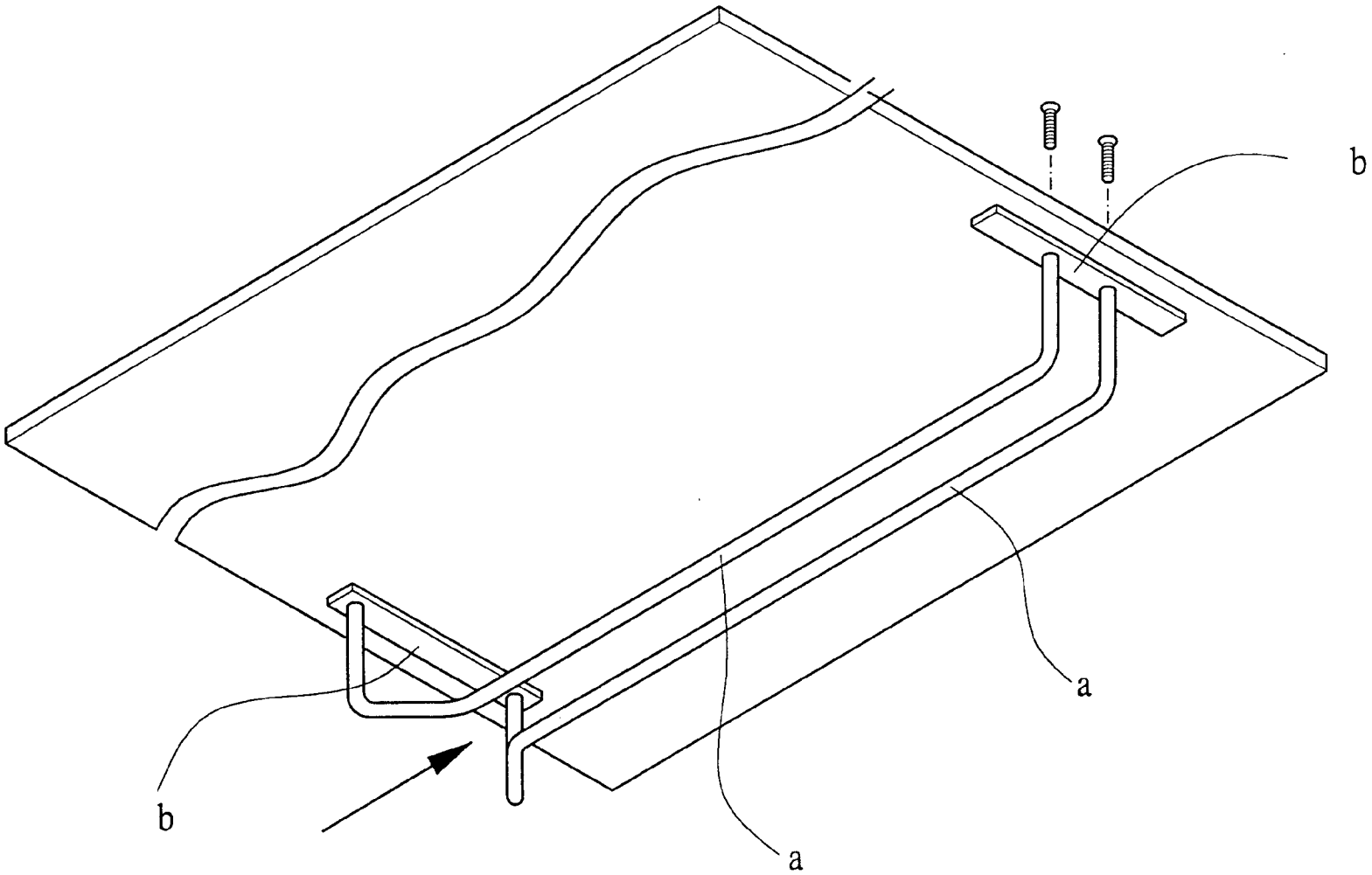
Fig.5 PRIOR ART
FIG. 5 is a perspective view of the prior art.

The glass rack can be placed in a cabinet 1 the same way as a shelf being put in a cabinet. There are two common ways of supporting the glass rack. One is to screw a set of brass bolts 6 onto the two lateral walls correspondingly inside the cabinet 1 (see FIG. 3). The other way is to install a pair of support frames 7 on the back wall, with each support frame consisting of a frame base 71 and an extending post 72. The posts 72 have protruding edges 73 that when the glass board 4 is placed on the posts 72, clip on the board 4 to ensure a stable positioning (see FIG. 4). The glass board 4 serves as shelf for the cabinet 1, offering storage space on its top, in addition to hanging wineglasses 5 with the tubular frame 3. The glass rack of the present invention provides more than one way of storage and has the advantage of requiring no screwing for installation.

While a preferred embodiment of the invention has been shown and described in detail, it will be readily understood and appreciated that numerous omissions, changes and additions may be made without departing from the spirit and scope of the invention.

What is claimed is:

1. A rack for wine glasses, comprising:

a first shelf support and a second shelf support, each being positionable on opposing walls of a cabinet, and each having a first slide track and a second slide track, said first slide tracks being positionable within the cabinet to face each other, said second slide tracks being positionable within the cabinet to face downwards;

a shelf slidably receivable within said first slide tracks; and a tubular frame including first and second rack bases, said first rack base being slidably receivable within said second slide track of said first shelf support, and said second rack base being slidably receivable within said second slide track of said second shelf support, said tubular frame further having first and second U-shaped support rods, one end of said first U-shaped support rod and one end of said second U-shaped support rod being mounted to said first rack base, and another end of said first U-shaped support rod and another end of said second U-shaped support rod being mounted to said second rack base, said U-shaped support rods being spaced apart from each other.

2. The rack recited in claim 1, wherein said first shelf support and said second shelf support are each comprised of metal.

3. The rack recited in claim 1, wherein said shelf is a glass shelf.

4. The rack recited in claim 1, wherein said U-shaped support rods are connected to an underside of said rack bases.

5. A rack for wine glasses, comprising:

a first shelf support and a second shelf support, each having a first slide track and a second slide track; and a frame including first and second rack bases, and having first and second U-shaped support rods, one end of said first U-shaped support rod and one end of said second U-shaped support rod being mounted to said first rack base, and another end of said first U-shaped support rod and another end of said second U-shaped support rod being mounted to said second rack base, said U-shaped support rods being spaced apart from each other;

wherein, when said rack is assembled, said first shelf support and said second shelf support are positioned on opposing walls of a cabinet with said first slide tracks being positioned within the cabinet to face each other, and with said second slide tracks being positioned within the cabinet to face downwards, said first rack base is slidably received within said second slide track of said first shelf support, and said second rack base is slidably received within said second slide track of said second shelf support, and a shelf is slidably receivable within said first slide tracks.

* * * * *